United States Patent [19]

Lasky et al.

[11] 4,456,804

[45] Jun. 26, 1984

[54] METHOD AND APPARATUS FOR APPLICATION OF PAINT TO METAL SUBSTRATES

[75] Inventors: Robert Lasky, Medford; Donald C. Lobach, Marlton; Edward J. Bauer, Cherry Hill, all of N.J.

[73] Assignee: Campbell Soup Company, Camden, N.J.

[21] Appl. No.: 397,830

[22] Filed: Jul. 13, 1982

[51] Int. Cl.[3] ..... H05B 6/40

[52] U.S. Cl. ..... 219/10.43; 219/10.57; 219/10.71; 219/10.79; 34/1; 118/620; 118/642; 427/45.1; 427/372.2; 427/379

[58] Field of Search ..... 219/10.41, 10.57, 10.43, 219/10.69, 10.71, 9.5, 8.5, 10.79, 10.75; 34/1, 4; 118/620, 624, 641, 642, 643, 58, 66; 427/45.1, 46, 55, 56.1, 331, 352, 372.2, 374.1, 379

[56] References Cited

U.S. PATENT DOCUMENTS

| | | | |
|---|---|---|---|
| 2,818,483 | 12/1957 | Blume | 219/10.41 |
| 3,794,802 | 2/1974 | Mohr | 219/10.43 X |
| 3,840,138 | 10/1974 | Mohr | 219/10.57 |
| 4,112,285 | 9/1978 | Pan et al. | 219/10.41 |
| 4,327,665 | 5/1982 | Arrasmith | 34/4 X |
| 4,389,964 | 6/1983 | Frei | 118/66 |

*Primary Examiner*—C. C. Shaw
*Assistant Examiner*—Philip H. Leung
*Attorney, Agent, or Firm*—Albert L. Free

[57] ABSTRACT

The flow of paint in a liquid paint stripe covering the inside of a side-seam weld extending along the top of a horizontally-disposed food can is controlled by applying induction heating to areas of the can on each side of the stripe, whereby a temperature gradient directed upwardly through the can is established to limit downward gravity flow of the paint before it sets, and thereby prevent formation of ridges and bubbles at the edges of the stripe.

9 Claims, 22 Drawing Figures

METHOD AND APPARATUS FOR APPLICATION OF PAINT TO METAL SUBSTRATES

BACKGROUND OF THE INVENTION

This invention relates to method and apparatus for controlling the configurations of liquid coatings, and particularly for controlling the configuration of a paint stripe covering the side-seam area on the inside of a food can.

In the making of a welded side-seam food container by bending a flat sheet of metal into cylindrical form and welding the resultant side seam, it is usual to coat the side of the sheet which will constitute the inside surface of the can with a food-inert paint or enamel, not only to provide an attractive appearance for the inside of the can but also to render it food-inert so that the can will not react with the contents and thereby produce objectionable or harmful reaction products.

In order to provide bare metal on the portions of the can which are to be welded to each other along the side seam, so as to enable satisfactory welding to take place, the corresponding margins of the original flat sheet are normally left uncoated, and will remain so after the side-seam welding has been completed, thereby forming an uncoated stripe region on the inside of the can adjacent to the linear weld. For the reasons indicated above, it has been found desirable to cover the uncoated side-seam weld area on the interior of the can with an inert coating which will be referred to herein as a paint stripe. It is important that this paint stripe be completely dried and cured before food products are placed into the completed can, so that it will be chemically inert and will contain no volatile components at that time.

It will also be understood that, in the interest of efficient production, it is desirable to move the welded cylindrical cans rapidly, and preferably at a uniform speed, through a paint-stripe applying stage and through subsequent paint drying and curing stages to the mechanism which completes formation of the can, the first element of which is usually a flanger which forms flanges at the opposite ends of the can cylinder; this and subsequent stages in the can formation are not part of the present invention, and need not be described in detail herein.

In order for the paint stripe to provide a good, continuous, adherent coating, it has been found desirable to apply the stripe by means of a paint spray head positioned to spray paint along and over the interior of the side-seam area as the can cylinders proceed along the production line. However, in this event a special problem arises from the fact that the side-seam welder customarily delivers the welded cylinders to its output end with the cylinder axis lying horizontally and with the welded side-seam lying along the top of the horizontally-lying can cylinder. The paint stripe is therefore applied by spraying the paint upwardly inside the cylinder, against the highest or top area of the interior of the cylinder, and both gravity and the pressure of the spray therefore tend to cause the paint to flow downwardly along the curved interior surfaces of the cylinder, away from its desired position, before it has dried sufficiently to set and hold its originally applied position. Further, since the side-seam presented to the sprayer is still hot from its immediately-preceding welding operation, the tendency for the paint to flow downwardly away from the seam area is further exacerbated. This tendency to flow downwardly not only thins the coating in the top region where an impervious continuous coating is desired, but has another important adverse result; at the edges of the stripe, where the downward flow is arrested by the adhesive, cohesive and surface tension properties of the paint and by its cooling, the paint will tend to pile up and form ridges, much like the familiar "sagging" of a wet wood-work enamel. When such a stripe is heated to dry and cure the paint stripe, the thick ridged areas tend to form bubbles, which is highly undesirable from the quality standpoint in the completed product. Such bubble formation is not only undesirable aesthetically, but also may produce little or no coating and reduced adherence of the paint in the areas where bubbles are formed.

The heating for accomplishing the setting, drying and curing of the paint stripe may be performed by high frequency induction heating applied to the upwardly presented surface of the can cylinder, whereby alternating currents in the induction heater elements produce corresponding alternating magnetic fields extending through the adjacent portions of the can cylinder, inducing therein eddy currents which heat the nearby portions of the can cylinder. Among the types of induction heaters which may be used for such purposes are the linear element induction heater and the serpentine element induction heater, described and defined more fully hereinafter.

In general, the linear element induction heater uses conductors which extend in a straight line parallel to the axis of the can cylinder, and may be placed over the side-seam weld area to produce concentrated local heating of this area and of the adjacent paint stripe on the interior of the cylinder. The serpentine element induction heater uses an element which sinuates back and forth across the top of the can, and at its outer reaches may bend progressively farther down around the can circumferentially, so as to maintain its rather close spacing to the outer surface of the can cylinder; such an induction heater element tends to induce more even heating of the can surface underlying the stripe.

It has been found that if the simple linear-element induction heater or the serpentine element induction heater is used according to the prior art as a sole source of heat for the initial heating of the paint stripe, the above-mentioned ridging and bubbling problems are encountered. It has also found desirable to perform the setting, drying and curing steps into three successive stages, namely, first induction heating of the stripe, followed by a "dwelling" or "resting" stage where additional induction heating is not applied and solvents are permitted and encouraged to evaporate quickly, followed by a second induction heating stage in which curing of the paint stripe is completed. While such a three-stage arrangement accomplishes the desired setting, drying and curing operations quickly and effectively, it is found that it does not in itself overcome the above-described problem of paint ridging and bubbling. This drawback of the process has been found to remain whether the first and second induction heatings are conducted with conventional linear induction heating elements or with serpentine induction heating elements.

SUMMARY OF THE INVENTION

In accordance with the invention, the above-described ridging and bubbling of a liquid coating on a sloping metal substrate is overcome by use of a method and apparatus which selectively heats the part of the substrate adjacent but below the edge of the coating to produce a negative temperature gradient in said substrate extending upward through and along said substrate, from just beyond the adjacent lower edge of said coating to the part of said substrate underlying said coating. This selective heating is preferably provided by linear induction heating means, a field-radiating element of which is disposed adjacent the part of the substrate just beyond and below the lower edge of said coating. It has been found that such heating prevents the downward flow of the coating which causes the undesired ridging and bubbling, and results in a smooth, uniform, adherent coating.

Preferably, in the case of a stripe coating applied to cover a side-seam weld extending along the top of a horizontally-disposed can cylinder, two horizontal linear induction-field radiating members are used, one adjacent but below each side edge of the stripe to prevent ridging and bubbling at each edge of the stripe, and the induction heating is continued until the material of the coating has set and will not flow. Also preferably, a pair of counter-electrodes are disposed parallel to and between the other two linear elements, and are alternating induction-heating voltage as applied between the counter electrode elements and the two lower linear elements after the induction heating process, the can cylinder is then dried further and heat cured; preferably the drying is done by moving the can cylinder to a "dwell" or "rest" station wherein induction heating is not applied and solvents in the coating material are permitted to escape. The curing is preferably accomplished by moving the can cylinder from the "dwell" station to a curing station in which a serpentine induction heater heats the can and coating quite uniformly, to effect uniform curing of the material of the stripe, after which the can cylinder is ready for the subsequent steps usual in can-manufacturing processes.

Accordingly, there is provided an apparatus and method by which a continuous, adherent reproducible coating or paint stripe may be provided along the top of the interior of a metal can cylinder, and dried and cured without the production of bubbles, in a manner which is fast, efficient and lends itself to the stripe painting of a sequence of can cylinders moving through the paint applying stage, the first induction heating stage, the dwell stage and the induction heater curing stage at a uniform high rate of speed.

BRIEF DESCRIPTION OF FIGURES

Objects and features of the invention will be more readily understood from the following drawings, in which.

DETAILED DESCRIPTION OF PREFERRED EMBODIMENTS

Figure 1:
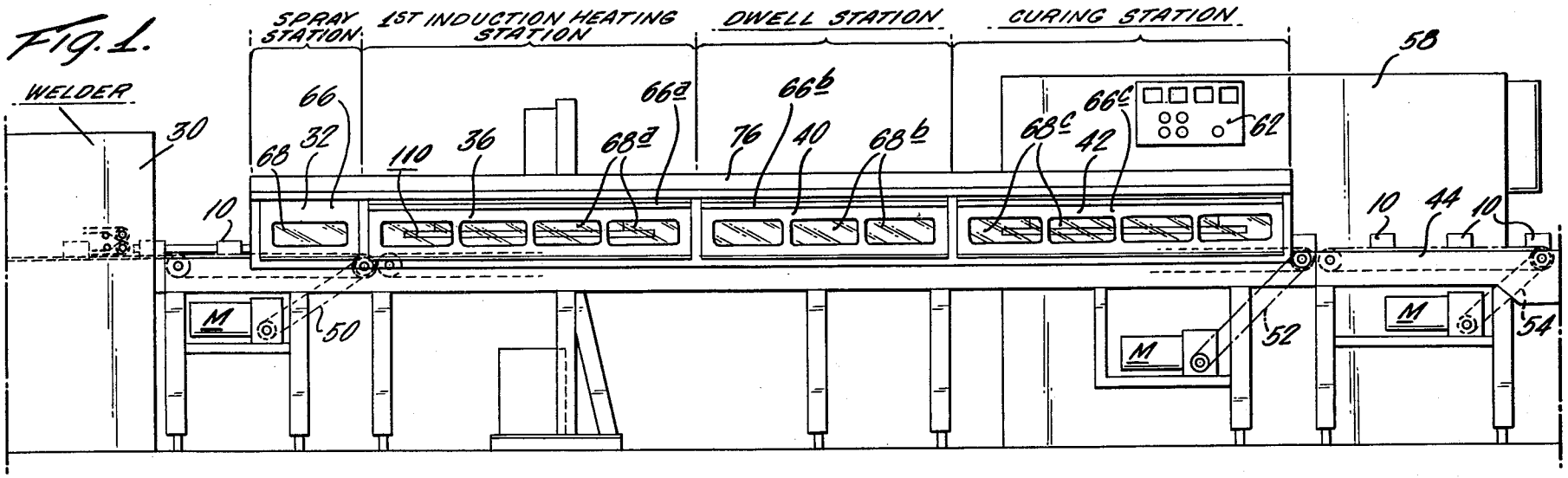
FIG. 1 is a schematic side elevational view of a preferred embodiment of the can striping and curing apparatus of the invention.
Figure 4A:
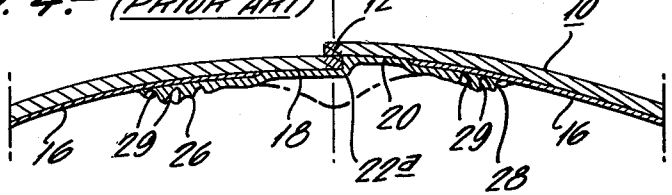
FIG. 4a (PRIOR ART)
FIG. 4*a* is a fragmentary sectional view of a prior art paint stripe.
Figure 4:
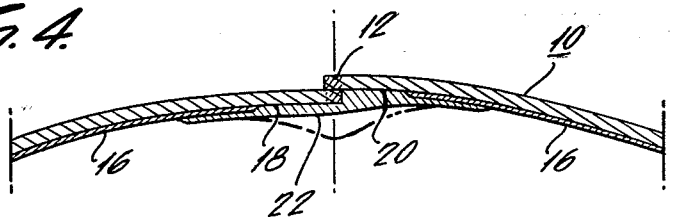
FIG. 4 is an enlarged fragmentary sectional view taken on the line 4,4 of FIG. 3.
Figure 3:
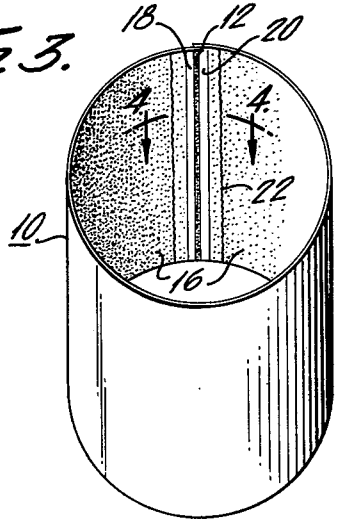
FIG. 3 is a perspective view of a welded can cylinder showing the paint stripe applied to the can cylinder weld zone.
Figure 2:
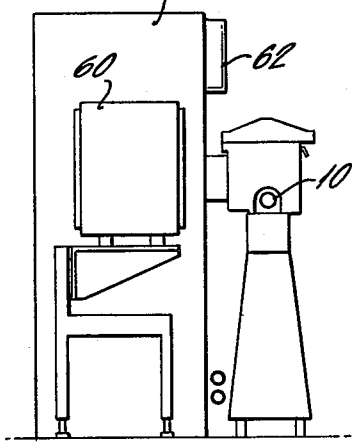
FIG. 2 is a left-end elevational view of the apparatus of FIG. 1.

Referring now to the specific embodiments of the invention shown in the drawings, in which corresponding parts are designated by corresponding numerals, FIGS. 1 and 2 show schematically a production line arrangement for side seam welding and paint striping of the can cylinder 10 shown in FIG. 3. The can cylinder 10, which in this example is assumed to be the body portion of a can for containing a food product, is side-seam welded along its entire length at 12. As is common practice, the can cylinder is formed by rolling it up into cylindrical form from flat metal stock, such as tin clad steel, and the ends of the rolled-up cylinder are overlapped slightly to provide the region in which the welding is conducted. As shown in FIGS. 4 and 4*a*, the extent of overlap is relatively small, e.g. for a can cylinder 2 11/16 inches in diameter and 4 inches long, the overlap may be about 0.015 inch. In this example, it will be assumed that the thickness of the cylinder material is about 0.0066 inches.

To protect the food product which is later to be placed into the can from direct exposure to the metal of the cylinder, the majority of the interior of the cylinder is provided with a thin coating 16, typically of an oleoresinous material applied to the flat stock before it is rolled-up into the cylinder. In order that the overlapped areas to be welded may be in direct metallic contact with each other and with the welding electrodes, areas 18 and 20 adjacent the weld line are left free of coating along the corresponding margins of the flat stock. After the welding is complete, the weld and the exposed metal on the interior of the can cylinder are covered with a paint stripe 22, which in this example is assumed to be nearly transparent but need not be so.

FIG. 4 shows in fragmentary cross-section, and not necessarily to scale, the relationship of the paint stripe 22 to the side seam weld 12 and the adjacent, originally bare margins 18 and 20, as is desired that this paint stripe should appear. The paint stripe is seen to be relatively uniform in thickness, and is properly adherent throughout its area.

Figure 17:
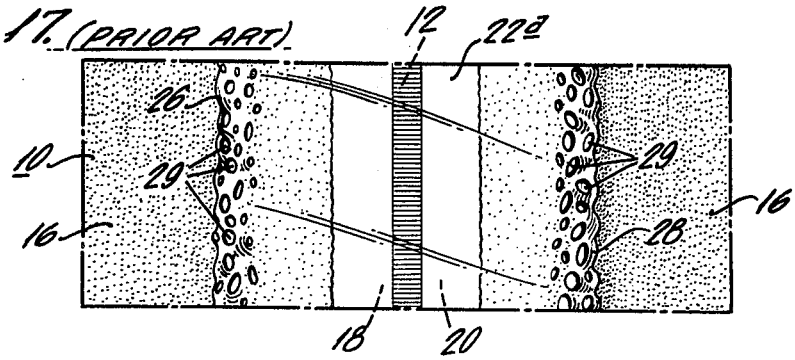
Fig. 17. (PRIOR ART)
FIG. 17 is a fragmentary enlarged view of the interior of the can cylinder taken on the line 17,17 of FIG. 16 showing the undesirable effects obtained by use of prior-art methods.

FIG. 4*a* illustrates, not necessarily to scale, the difficulty which has been encountered in previous attempts to apply, dry and cure the paint stripe. In this case, the paint stripe 22*a* tends to be thinned at the upper portion thereof adjacent the weld, and to have thickened, ridged portions along both margins, at 26 and 28. Upon completion of the curing process, the ridged or thickened portions tend to exhibit bubbles and pits such as 29, as shown more clearly in FIG. 17 hereof. As pointed out above, the paint stripe of FIGS. 4*a* and 17 is undesirable, and the objective is to achieve a paint stripe like stripe 22 of FIG. 4, which is smooth, substantially uniform and adherent, and free of bubbles.

Turning now to FIGS. 1 and 2 showing schematically the general arrangement of the equipment for welding the side seam of the can cylinder and for providing thereon the final cured paint stripe of desired form shown in FIGS. 3 and 4, it will be understood that the can cylinders are fed sequentially, in a train, with the side seam facing upward, through a conventional side seam welder 30 which welds the side seam 12 as the can passes through the welder by means of a series of small overlapping welds, as may readily be accomplished by a conventional wire welder in which the opposing electrodes are formed of wire members. The cans then continue along the line, first passing through a paint spray station 32 wherein a paint spray head (not shown in FIG. 1) mounted near the axis of the can cylinder directs a continuous spray upward against the interior of each can cylinder, encompassing and covering the interior of the weld and the adjacent bare marginal areas of the cylinder as they pass by and around the spray head. The cans then pass through a first induction heating station 36, wherein the paint stripe is heated and dried sufficiently to cause the paint of the stripe to set and hold its geometric form. The cans then exit from the first induction heating station and pass through a "dwell" station 40, wherein they are permitted to be free of heating while volatile elements are permitted to escape from the paint in preparation for entry into the final curing station 42, wherein the cans and the stripes are again induction heated so as to effect the final curing of the paint. After leaving the curing station, the cans are received by an output conveyor 44 for delivery to apparatus for performing subsequent steps in completing the formation of the final food product can, in conventional manner.

In the form shown in FIG. 1, separate motors and chain drives 50, 52 and 54 are provided to operate the conveyor belts for the spray station, for the first induction heating station, dwell station and curing station, and for the output conveyor, respectively.

A commercial high-frequency induction-heating generator 58 and associated transformer 60 provide the energy for the requisite induction heating, and are located adjacent the can line. Also provided is a control panel 62, with associated electrical equipment for controlling the various operations of the induction heaters and of the motor drive units.

With this general organization in mind, further details of the preferred embodiment will be described with particular reference to FIGS. 5–12.

Figure 5:
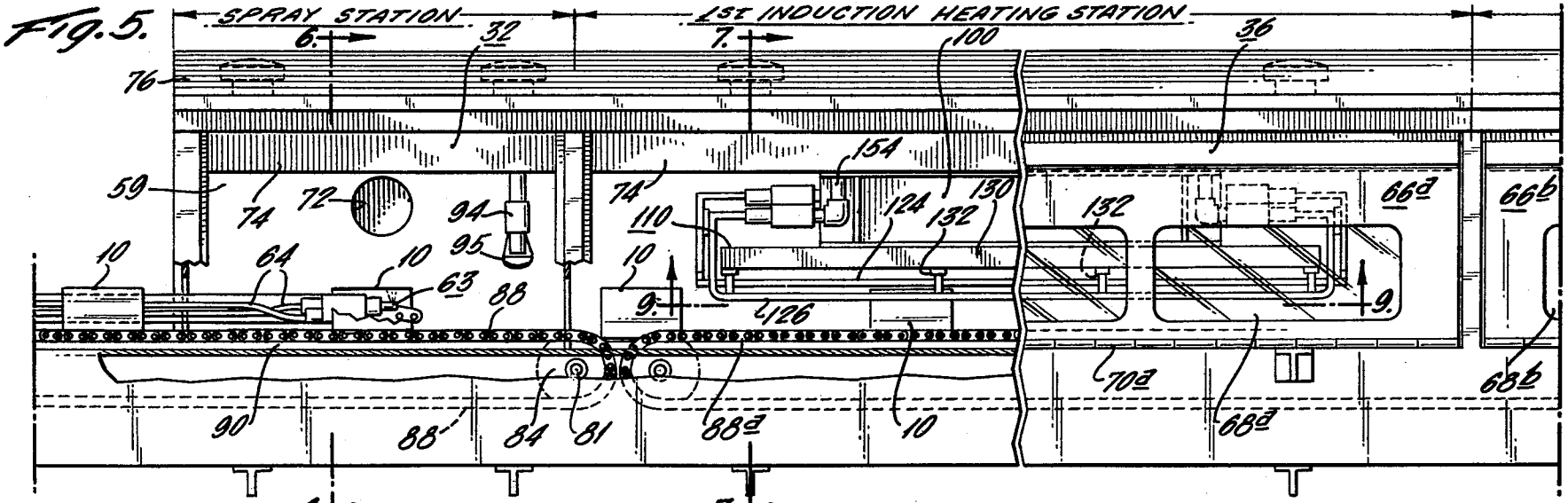
FIG. 5 is an enlarged fragmentary side elevational view partially in section and with parts broken away, showing in more detail a portion of the paint spraying and curing apparatus shown in FIG. 1.
Figure 5A:
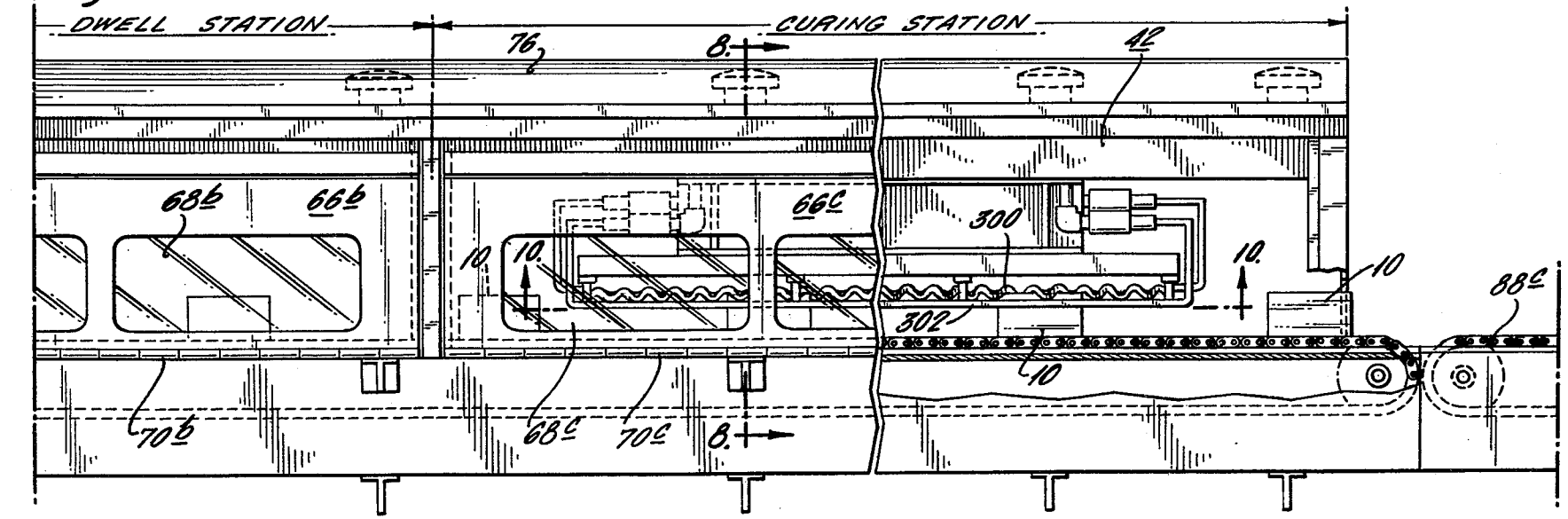
FIG. 5*a* is a view similar to that of FIG. 5, showing the remainder of the apparatus.

FIG. 5 is a side view of the can line, extending from a point just prior to the spray station 32 to the beginning portion of the dwell station 40; FIG. 5*a* is a similar view running from near the end of the dwell station 40 to the end of the curing station 42.

Figure 6:
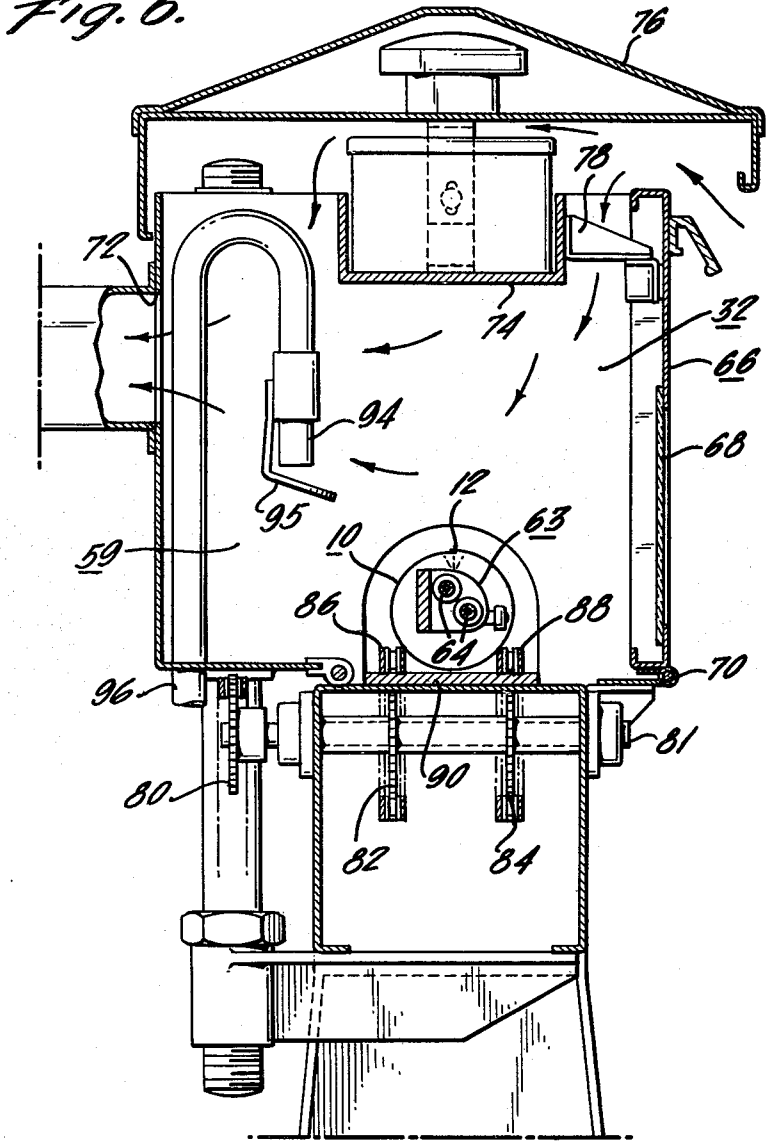
FIG. 6 is an enlarged transverse sectional view through the spraying station taken on the line 6,6 of FIG. 5.

Referring first to the spray station shown in FIGS. 5 and 6, this comprises a compartment 59 containing the paint spray head 63 and air and paint supply lines 64 which extend axially of the cans, upstream through the welder 30 to and beyond the position at which the flat can stock is first formed into a cylinder, the air and paint supply being connected to the air and paint supply lines at the upstream side of the latter cylinder-forming stage (not shown). The compartment 58 has a door 66 containing windows such as 68, the door being pivotable on a hinge 70 to provide access to the interior of the compartment. A vent opening 72 is provided in the opposite wall of the compartment, and a lengthwise tunnel 74 is provided which extends along the can line near the top of this compartment and of other compartments along the can line, and which contains various auxiliary equipment such as hoses and the like. A roof member 76 extends over the top of the compartment, the tunnel member 74 carries brackets 78 mounted to its front wall leaving openings for the flow of ambient air above the door, through the interior of the compartment, and through the vent opening 72 as indicated by the arrows in FIG. 6.

The can cylinders 10 are moved by means of a chain driven sprocket 80 turning an axle 81, on which are mounted further chain sprockets 82 and 84 positioned on each side of the can, and which engage and drive parallel endless chains 86 and 88. The can cylinders 10 nest between the chains 86 and 88, and are urged downward against them by a magnetized bed 90, which extends along the conveyor line so as to hold the cans positively in the desired orientation at all times.

Also provided is a fire extinguisher arrangement 94 having its outlet end 95 positioned within the compartment 59 and capable of being supplied at its opposite end 95 with suitable fire extinguishing fluid should the paint spraying in the presence of the hot side-seam weld lead to a fire within the compartment.

Figure 7:
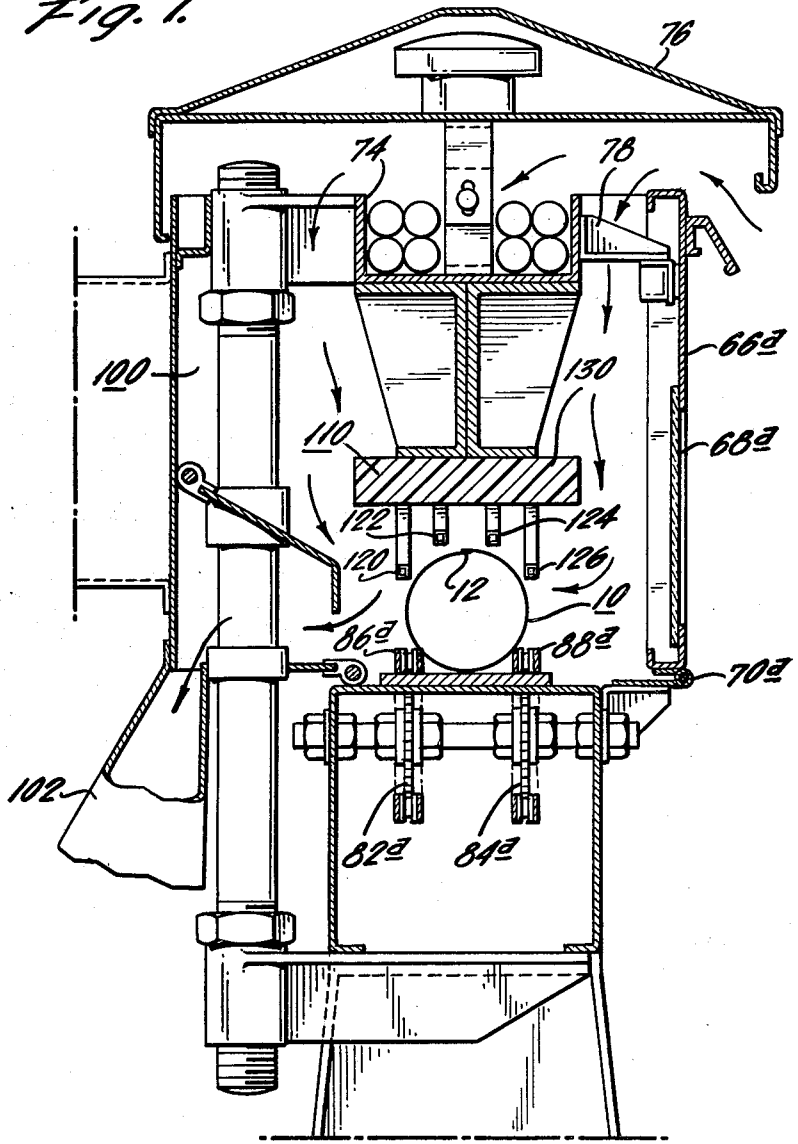
FIG. 7 is an enlarged transverse sectional view through the induction heating station taken on the line 7,7 of FIG. 5.

FIGS. 5 and 7 show details of the first induction heating station 36.

The first induction heating station comprises a compartment 100 similar in main structural components to the compartment of the spray station, with similar arrangements for holding and moving the can cylinders along and through the compartment, for permitting the flow of ambient air into, through and out of the compartment by way of the air outlet 102; the same type of roof member and the same tunnel are used as in the spray station. Mounted above the path of the can cylinder is the linear induction heater 110, shown in further detail in FIGS. 9, 11 and 18. It comprises four straight, axially-extending linear induction heater members 120, 122, 124 and 126. All four are mounted from a common support plate 130 by appropriate stand-off insulators such as 132, support plate 130 being mounted from and below the bottom of the tunnel 74. The linear induction heating elements are equally spaced from each other peripherally about an arc concentric with the can cylinder 10, and are positioned symmetrically with respect to the side seam weld 12.

Figure 9:
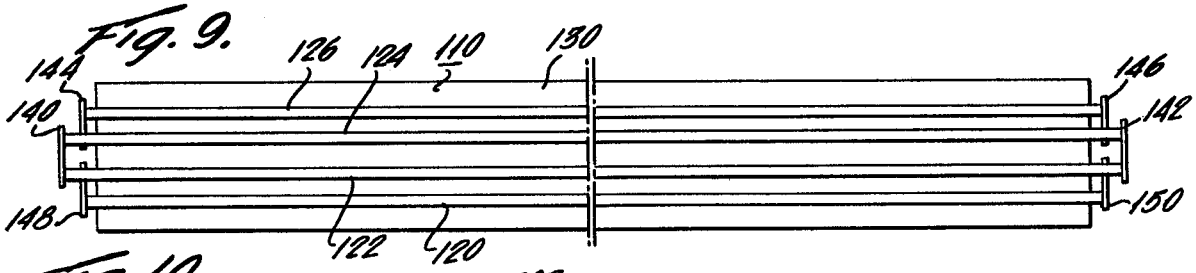
FIG. 9 is a bottom plan view of the induction heating elements of the induction heating station, taken on lines 9,9 of FIG. 5.
Figure 10:
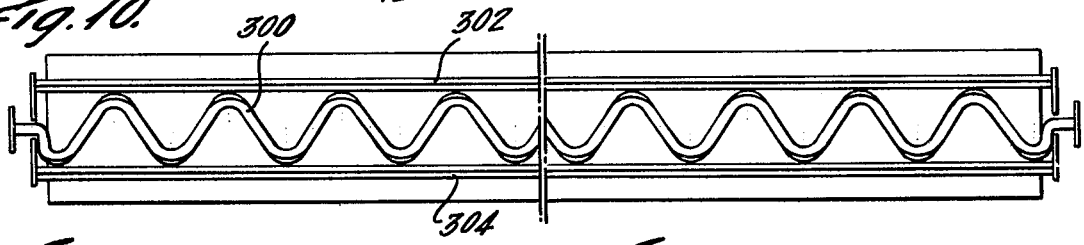
FIG. 10 is a bottom plan view of the induction heating elements of the curing station, taken on line 10,10 of FIG. 5*a;*
Figure 11:
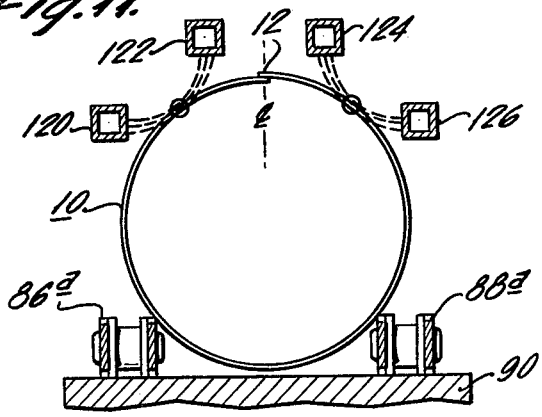
FIG. 11 is an enlarged fragmentary transverse sectional view of a can cylinder positioned within the first induction heating station.
Figure 12:
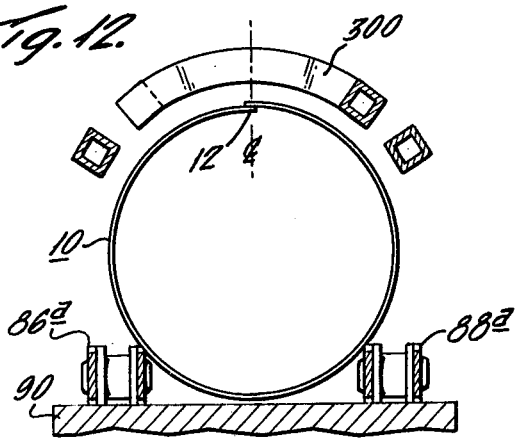
FIG. 12 is a view similar to FIG. 11 but showing the can cylinder positioned within the final curing station.
Figure 13:
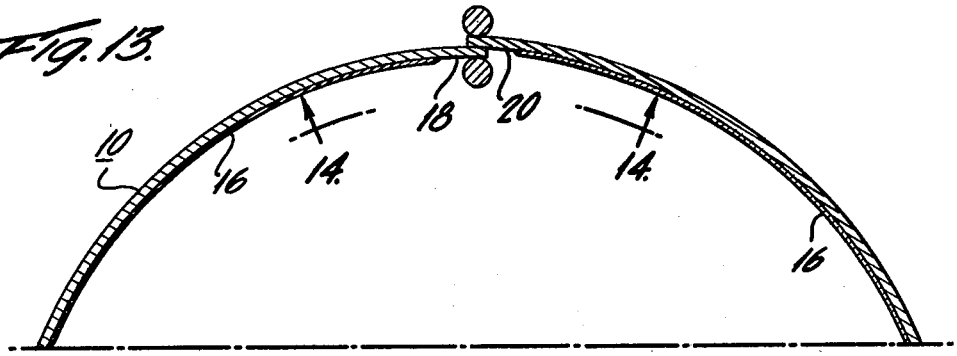
FIG. 13 is a greatly enlarged fragmentary sectional view of a can cylinder with its overlapping ends about to be welded by means of a wire-welding device.

As shown particularly clearly in FIG. 9, the two central linear induction-heater members 124 and 126 are electrically connected together by members 140 and 142, and these members are electrically connected to one terminal of the transformer 60 by an appropriate electrical cable (not shown). The end members 144, 146, 148 and 150 for induction-heater elements 120 and 126 are connected by any suitable cable arrangement (not shown) to the other or opposite output terminal of the induction-heater transformer 60. Suitable water-cooling lines such as 154 (FIG. 5) provide a flow of cooling water through the interiors of the induction heater elements, in conventional manner. The specific preferred arrangement and configuration of these linear elements with respect to each other and with respect to the cylinder can will be described more fully hereinafter with reference to others of the figures.

Figure 8:
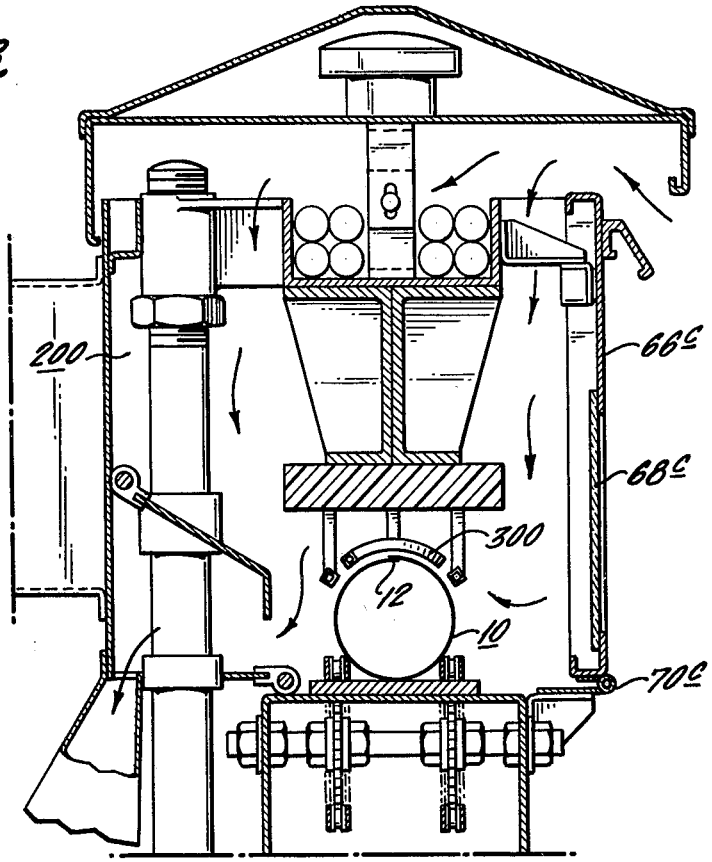
FIG. 8 is an enlarged transverse sectional view taken on the line 8,8 of FIG. 5*a* showing details of the curing station.

FIGS. 5*a* and 8 show the curing stage, which employs a similar compartment 200, similar support and conveying means for the can cylinders, and similar provisions for a flow-through of ambient air. It also contains the induction heater elements for effecting final curing. In this case a serpentine induction-heater members is utilized, made up (as shown especially clearly in FIGS. 10 and 12) of a central serpentine induction heater element 300 and two adjacent, straight, axially-extending induction-heator elements 302 and 304. The latter three elements are preferably water-cooled in conventional manner, and the serpentine element is connected to one output terminal of the transformer 60 for the induction-heating high-frequency generator 58 and the other two straight elements are connected to the opposite output terminal by appropriate connectors (not shown). As can be seen from FIGS. 10 and 12, for example, the serpentine element not only sinuates back and forth across the top of the can cylinder as viewed from above, but also curves downwardly around and adjacent the top portion of the can cylinder at a fixed spacing therefrom. Such a heating element per se is known in the prior art and has been found to provide a rather uniform, generalized heating of the adjacent can area, and of the applied paint stripe, suitable for effecting a final curing of the paint.

Figure 14:
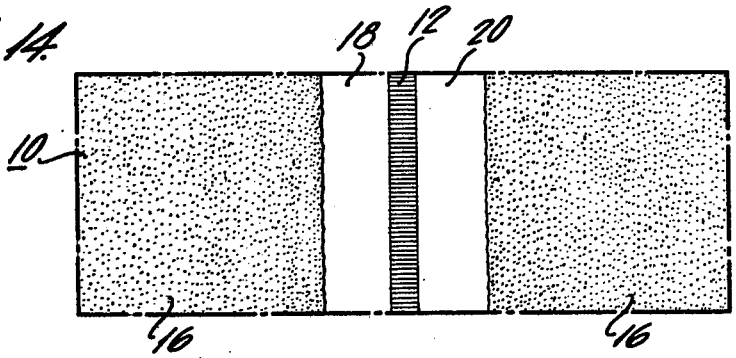
FIG. 14 is a fragmentary inner face view of the can cylinder shown in FIG. 13, taken on the line 14,14 of FIG. 13, and enlarged even more greatly than FIGS. 13 and 15.

Referring now particularly to FIGS. 13–19, FIG. 13 illustrates the condition of upper can cylinder surfaces as it passes between the wire electrodes through the wire welder to effect seam welding. FIG. 14 shows the side seam 12, the adjacent bare areas 18 and 20 of the interior of the can cylinder, and the coating 16 which covers the remainder of the interior of the can cylinder.

Figure 15:
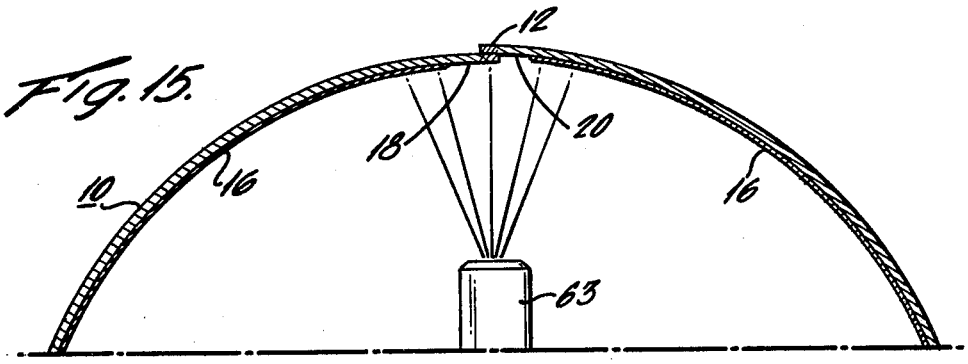
FIG. 15 is a greatly enlarged fragmentary sectional view of a welded can cylinder being sprayed with paint to form the paint stripe.

FIG. 15 illustrates the spraying of the paint onto the interior of the top of the can cylinder to form the paint stripe, by means of the paint spray head 63, the spray being applied so as to cover the originally weld 12 and the originally-bare portions 18 and 20.

Figure 16:
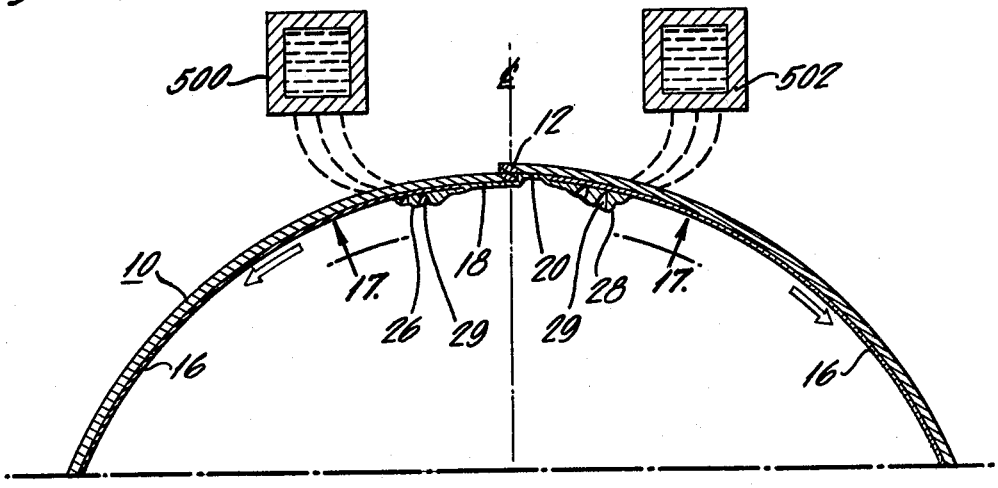
Fig. 16. (PRIOR ART)
FIG. 16 is a fragmentary enlarged sectional view of the can shown in FIG. 15 after the stripe has been applied and heated and cured according to prior-art methods.

FIG. 16 illustrates the prior-art arrangement in which two linear induction heating elements 500 and 502 are placed above the can adjacent opposite sides of the weld area, to heat the can and the paint stripe as the can cylinder passes beneath them. In such prior-art arrangement, the two linear elements are supplied from the opposite output terminals of the high-frequency induction heater generator, and the magnetic flux lines between the two elements traverse the top portion of the can, as suggested by the broken lines. The result, in conjunction with the remaining heat in the side-seam weld area, is a concentration of heat, and production of a temperature maximum, in the can cylinder at adjacent the seam weld. It has been found that when such technique is used, the paint stripe becomes ridged at its edges and bubbles or blisters occur, as shown particularly in FIGS. 16 and 17, the ridges being shown at 26 and 28 and the typical bubbles or pockmarks at 29 for example.

Figure 18:
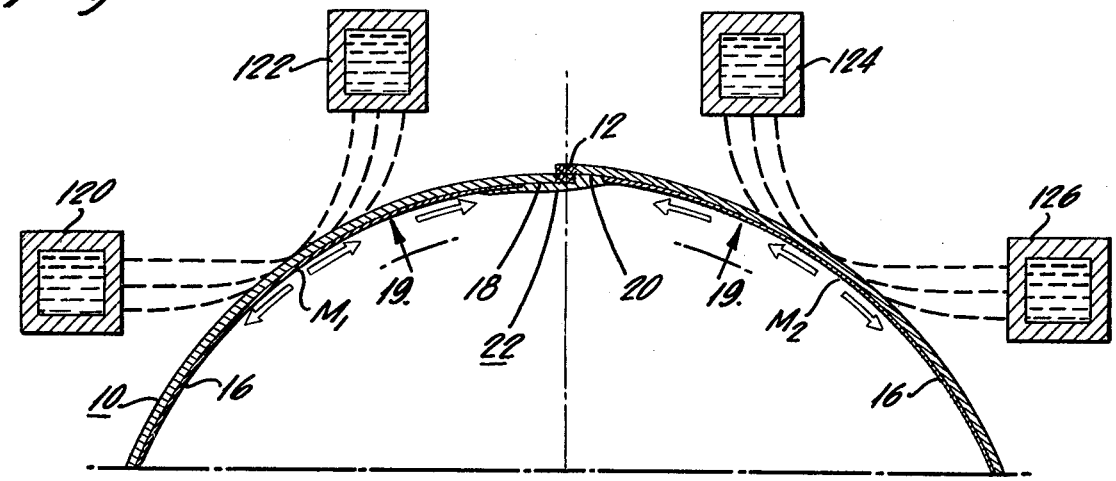
FIG. 18 is a view similar to FIG. 16 but showing the desirable paint stripe configuration obtained by the application of induction heating in the manner of the invention.
Figure 19:
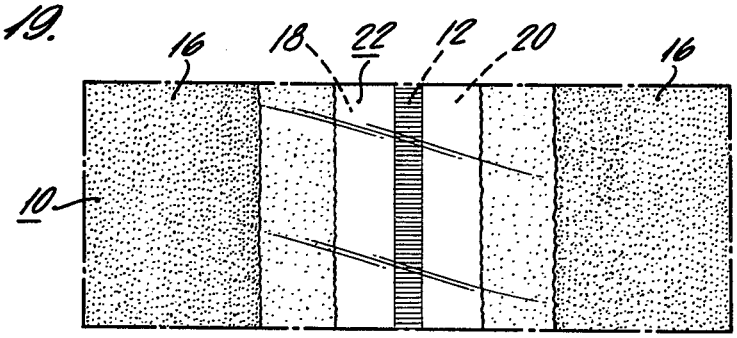
FIG. 19 is a fragmentary enlarged view similar to that of FIG. 14, taken on the line 19,19 of FIG. 18, and showing the desirable results obtained by means of the invention.

FIG. 18 shows the arrangement of the linear induction-heater elements 120, 122, 124 and 126 according to this embodiment of the invention. From FIG. 18 it will be appreciated that the magnetic flux (suggested by the broken lines) from the linear induction-heater elements produces maximum heating of the can cylinder at the circumferential positions $M_1$ and $M_2$ along the can cylinder and located somewhat downwardly from the opposite margins of the paint stripe 22. As a result, there is a negative gradient of temperature in the can cylinder along the upward direction from $M_1$ and $M_2$ toward the side-seam weld 12, as suggested by the open arrows. The effect of this arrangement and gradients is to eliminate the ridging and bubbling or blistering occurring in the prior-art paint stripes. The induction heating illustrated in FIG. 18 is conducted sufficiently long to cause the paint stripe 22 to set, providing the smooth, rather uniform, adherent and bubble-free stripe shown in FIGS. 4, 18 and 19.

While all of the details of the theory of operation of the invention in providing the desired control of the paint stripe are not fully understood, it appears that the paint tends to flow in the direction of the temperature gradient, apparently because of the increased activity of the solvent at the higher temperatures. Accordingly, the temperature gradient described above counteracts the tendency of the paint to flow downwardly by gravity, and thus prevents the previously-described ridging and accompanying bubbling; it has in fact been found that if the induction heating applied in this manner is excessive, the paint may be driven preferentially upward, toward the side-seam weld 12, to such an extent that a resultant paint thickening occurs near the center of the strips, with accompanying bubbling or blistering, and such excessive application of induction heating should therefore be avoided for the present purposes.

The following is a specific example of values of parameters for one preferred embodiment of the invention. Starting with a can cylinder stock made of 0.0066 inch thick tin-coated steel, the stock is rolled into a cylinder 4 inches long and about 2 11/16 inches in diameter with about 0.015 inch overlap, and the side-seam weld formed by conventional wire welding. The original coating which covers a majority of the interior of the can may be of an oleoresinous material applied by a roll coater to leave a bare margin about 0.100 inch in width at each side of the flat stock before it is rolled up into a cylinder. The can cylinders may be moved along the line at a rate of about 170 feet per minute; the length of the spray station may be about 20 inches, the length of the first induction heating station about 48 inches, the length of the dwell station about 60 inches and the length of the curing station about 48 inches. This can cylinder rate of motion and the above specific lengths of the three stations define suitable times for the can cylinders to be in each of the stations to produce the results described.

The paint is preferably a modified acrylic, which is a mixture of acrylic, epoxy and melamine in a solvent of the following composition:

| | % Weight | % Volume |
|---|---|---|
| Cellosolve Acetate | 31.53 | 29.01 |
| MEK | 20.55 | 22.91 |
| Cyclohexanone | 10.34 | 9.78 |
| Toluene | 10.34 | 10.70 |
| Xylene | 3.62 | 3.73 |
| Aromatic 150 | 22.62 | 22.87 |
| Cellosolve | 0.88 | 0.86 |
| n-Butyl Alcohol | 0.12 | 0.14 |
| | 100.00% | 100.00% |

This type of paint is set and/or cured by the application of heat to accomplish polymerization.

It will be understood that the term "paint" is used in this application in a broad sense to include what are sometimes referred to as varnishes, and the following are other examples of suitable paints:

a. Acrylics
b. Epoxy Phenolics
c. Epoxys
d. Vinyls
e. Oleoresins

The width of the stripe as first applied may be about 0.32 inches, and the rate of application may be about 2.25 milligrams per inch of stripe. A typical thickness of the stripe upon completion of the process is about 0.0005 inch. A suitable frequency and power for the induction heating generator are 450 kilohertz and 30 kilowatts, respectively, for both the first induction heating and the final curing.

The preferred material for the linear induction heater elements is copper, with an outer cross-section of about ¼ inch by ¼ inch; each of the linear elements of the first induction heater may be about 48 inches in length. In this example, the cross sections of the linear heater elements are positioned along a cylindrical arc concentric with the can cylinder and spaced about ⅛ inch radially outward from the exterior of the can cylinder.

The serpentine induction heater element may have the same cross section as the linear heating elements, and the same is true of the straight heating elements used in conjunction with the serpentine element. The length of each of the latter elements may be about 48 inches, the induction heating power being supplied by a 30 kilowatt radio frequency generator at about 450 kilohertz.

Figure 20:
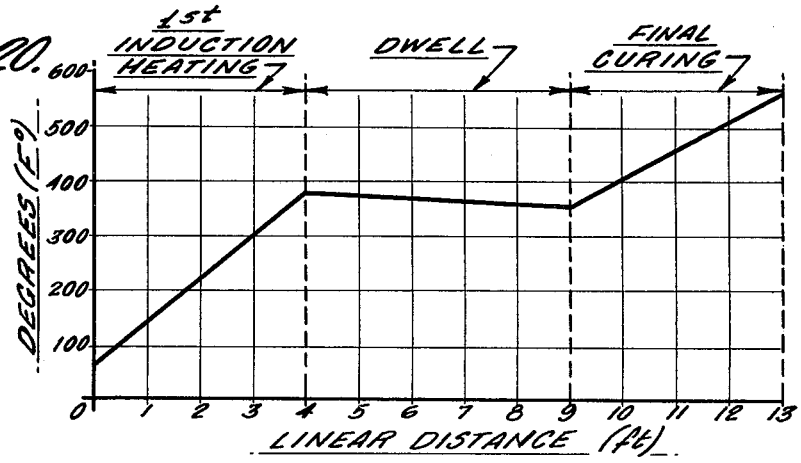
FIG. 20 is a graphical representation showing a typical profile of the temperatures produced on the can cylinder under the stripe at various points along the heating and curing apparatus of the invention.

FIG. 20 illustrates a typical temperature profile of the can cylinder measured at positions adjacent the side seam weld as the can cylinder passes through the first induction heating station, the dwell station and the curing station in the example described above.

It will therefore be appreciated that there has been provided a method and apparatus by which the tendency of the liquid of a coating to flow or spread outwardly can be controlled arrested, and ridging and bubbling near the margins prevented, by the use of a particular arrangement of linear induction heaters positioned to provide a maximum temperature adjacent but beyond the opposite margins of the paint coating, and accordingly a negative temperature gradient in a direction to oppose flow of the paint toward its margins.

Although the invention has been described in detail for the case in which the flow of paint in a paint stripe near the top of the interior of a can is controlled, it may also be used to control the flow of paint in a stripe on the exterior of the can, or the the flow of paint in a stripe which is at the bottom of the can or at a position intermediate the top and bottom.

Accordingly, while the invention has been described with respect to specific embodiments thereof in the interest of complete definiteness, it will be understood that it may be embodied in a variety of forms diverse from those specifically shown and described, without departing from the spirit and scope of the invention as defined by the appended claims.

What is claimed is:

1. The method of controlling the flow along a metallic substrate of a liquid coating containing a solvent and a solute, comprising:

induction heating said substrate selectively adjacent a marginal portion of said coating to establish in said body a temperature which is higher in a first part of said substrate just outside said marginal portion than it is in a second part of said substrate underlying said marginal portion of said coating, thereby to establish a negative temperature gradient extending from said first part of said substrate to said second part of said substrate;

maintaining said induction heating and said gradient until said coating has set sufficiently to prevent flow of said coating when said induction heating is discontinued; and thereafter discontinuing said induction heating.

2. The method of claim 1, wherein said substrate comprises a hollow metal cylinder, said coating is applied to the top of the interior of said cylinder in the form of a stripe extending parallel to the axis of said cylinder, and said marginal portion of said coating comprises one of the opposite side edges of said stripe.

3. The method of claim 2, wherein the part of said cylinder beneath said stripe contains an axially-extending heat-bonded seam which, at the inception of said induction heating, retains its heated condition due to said heat bonding.

4. In a method of providing a paint stripe on the interior surface of a welded side-seam can cylinder so as to cover an area encompassing the side seam and adjacent regions on both sides of the side seam, comprising spraying paint onto said area while said can cylinder is horizontal and while said side seam is disposed in a horizontal position along the top of the can cylinder, and subsequently heating and curing said paint stripe, the improvement wherein:

said heating comprises applying induction heating to parts of said can cylinder adjacent but beyond the opposite margins of said stripe to provide a temperature in said parts of said can cylinder which is greater than that of parts of said can underlying the marginal portions of said stripe, whereby ridging of said paint stripe at its margins is prevented, maintaining said induction heating until said stripe has set and will retain its configuration when said induction heating is terminated, and thereafter terminated said induction heating.

5. The method of claim 4, comprising discontinuing heating of said can cylinder for a predetermined time interval, and thereafter curing said stripe by additional induction heating of said can cylinder substantially uniformly over the part thereof underlying said stripe.

6. Apparatus for the drying and curing of a horizontal initially-liquid stripe extending along the top of a horizontal can cylinder for a metal food container and parallel to the axis thereof, comprising:

means for moving said container axially along a predetermined path;

a linear-element induction heater at a first location along said path, said induction heater having a plurality of linear elements, the linear elements of which heater are operatively positioned parallel to said stripe as said object moves along said path, at least two of said linear elements being positioned adjacent, and circumferentially spaced from, the opposite edges of said stripe to concentrate the heat thereby induced in said container in bands extending on both sides of said stripes as said container moves along said path;

a serpentine induction heater operatively positioned at a second location above and along said path and spaced downstream from said linear element induction heater;

the length of said linear-element induction heater along said path and the heat induced thereby in said container at said first location being such that said paint is constrained against flowing downwardly along said container and forming ridges at the edges of said stripe, and such that upon the exiting of the container from said first location the stripe is set in position on said container;

a dwell station along the length of said path between said first and second locations which is free of induction heating, for allowing the temperature in said stripe to equalize and to allow volatile components of said paint to escape therefrom;

the length of said serpentine induction heater along said path and the heat induced thereby in said container being such as to cure said paint and render it substantially inert to food materials.

7. The apparatus of claim 6, comprising means for moving said container axially along said path at a substantially constant speed.

8. The apparatus of claim 6, wherein the dwell times of said container in said first location, in said dwell station, and in said second location, are substantially 1.4 seconds, 1.75 seconds, 1.4 seconds, respectively.

9. The apparatus of claim 6, wherein said linear-element induction heater comprises another pair of linear induction heating elements extending parallel to said stripe, spaced from each other and positioned circumferentially between said at least two linear induction heating elements, and means for applying an alternating voltage between each of said other pair and said at least two linear elements.

* * * * *